US007476047B2

(12) United States Patent
Brunner et al.

(10) Patent No.: US 7,476,047 B2
(45) Date of Patent: Jan. 13, 2009

(54) ACTIVATABLE CLEANING PRODUCTS

(75) Inventors: Michael S. Brunner, Roswell, GA (US); Jason Lye, Atlanta, GA (US); Teri Taylor Kish, Roswell, GA (US); Jeffrey E. Fish, Dacula, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 489 days.

(21) Appl. No.: 10/844,568

(22) Filed: Apr. 30, 2004

(65) Prior Publication Data

US 2005/0244211 A1 Nov. 3, 2005

(51) Int. Cl.
*B05C 21/00* (2006.01)

(52) U.S. Cl. ..... 401/134; 401/133; 401/205

(58) Field of Classification Search ..... 401/132–135, 401/205, 207, 196
See application file for complete search history.

(56) References Cited

U.S. PATENT DOCUMENTS

| | | | |
|---|---|---|---|
| 2,980,940 | A | 4/1961 | Crowe |
| 3,299,464 | A | 1/1967 | O'Brien et al. |
| 3,338,992 | A | 8/1967 | Kinney |
| 3,341,394 | A | 9/1967 | Kinney |
| 3,386,793 | A | 6/1968 | Stanton |
| 3,481,676 | A | 12/1969 | Schwartzman |
| 3,485,562 | A | 12/1969 | Hidden et al. |
| 3,494,821 | A | 2/1970 | Evans |
| 3,502,538 | A | 3/1970 | Petersen |
| 3,502,763 | A | 3/1970 | Hartmann |
| 3,542,615 | A | 11/1970 | Dobo et al. |
| 3,640,877 | A | 2/1972 | Gobert |
| 3,692,618 | A | 9/1972 | Dorschner et al. |
| 3,768,916 | A | 10/1973 | Avery |
| 3,802,817 | A | 4/1974 | Matsuki et al. |
| 3,849,241 | A | 11/1974 | Butin et al. |
| 3,855,046 | A | 12/1974 | Hansen et al. |
| 3,998,559 | A | 12/1976 | Hoyt |
| 4,027,985 | A | 6/1977 | Loesser, III |
| 4,084,910 | A | 4/1978 | LaRosa |
| 4,100,324 | A | 7/1978 | Anderson et al. |
| 4,144,370 | A | 3/1979 | Boulton |
| 4,148,318 | A | 4/1979 | Meyer |
| 4,291,697 | A | 9/1981 | Georgevich |

(Continued)

FOREIGN PATENT DOCUMENTS

| | | |
|---|---|---|
| DE | 2557623 | 6/1977 |

(Continued)

OTHER PUBLICATIONS

KC# 20491, filed Mar. 12, 2004, entitled "Method for Scavenging Oxygen in Packaging Applications and Resulting Packages".

(Continued)

*Primary Examiner*—David J Walczak
(74) *Attorney, Agent, or Firm*—Dority & Manning, P.A.

(57) ABSTRACT

A cleaning product having a reservoir and a cleaning pad. The reservoir contains a first reactant that is released upon the application of a certain force that ruptures the reservoir. A second reactant is applied to the cleaning pad that is placed into contact with the first reactant when the reservoir is ruptured.

24 Claims, 4 Drawing Sheets

U.S. PATENT DOCUMENTS

| | | | | |
|---|---|---|---|---|
| 4,318,818 | A | 3/1982 | Letton et al. | |
| 4,330,220 | A | 5/1982 | Schaar et al. | |
| 4,340,563 | A | 7/1982 | Appel et al. | |
| 4,415,288 | A | 11/1983 | Gordon et al. | |
| 4,430,013 | A | 2/1984 | Kaufman | |
| 4,469,463 | A | 9/1984 | Van Overloop | |
| 4,475,835 | A | 10/1984 | Verboom et al. | |
| 4,478,530 | A | 10/1984 | Van Overloop | |
| 4,525,091 | A | 6/1985 | Van Overloop | |
| 4,526,773 | A | 7/1985 | Weber | |
| 4,563,103 | A | 1/1986 | Van Overloop et al. | |
| 4,576,817 | A | 3/1986 | Montgomery et al. | |
| 4,578,265 | A | 3/1986 | Pellico et al. | |
| 4,659,609 | A | 4/1987 | Lamers et al. | |
| D290,292 | S | 6/1987 | Gatarz | |
| 4,784,506 | A | 11/1988 | Koreska et al. | |
| 4,828,556 | A | 5/1989 | Braun et al. | |
| 4,833,003 | A | 5/1989 | Win et al. | |
| 4,885,155 | A | 12/1989 | Parran, Jr. et al. | |
| 4,948,427 | A | 8/1990 | Yamagishi et al. | |
| 5,048,589 | A | 9/1991 | Cook et al. | |
| 5,090,832 | A | 2/1992 | Rivera et al. | |
| 5,094,559 | A | 3/1992 | Rivera et al. | |
| 5,270,337 | A | 12/1993 | Graf | |
| 5,284,703 | A | 2/1994 | Everhart et al. | |
| 5,284,871 | A | 2/1994 | Graf | |
| 5,348,943 | A | 9/1994 | Pickart | |
| 5,350,624 | A | 9/1994 | Georger et al. | |
| 5,382,400 | A | 1/1995 | Pike et al. | |
| 5,399,412 | A | 3/1995 | Sudall et al. | |
| 5,510,001 | A | 4/1996 | Hermans et al. | |
| 5,555,673 | A * | 9/1996 | Smith | 47/1.5 |
| 5,591,309 | A | 1/1997 | Rugowski et al. | |
| 5,591,510 | A | 1/1997 | Junker et al. | |
| 5,620,779 | A | 4/1997 | Levy et al. | |
| 5,637,194 | A | 6/1997 | Ampulski et al. | |
| 5,654,164 | A | 8/1997 | Gardiol et al. | |
| D390,708 | S | 2/1998 | Brown | |
| 5,772,845 | A | 6/1998 | Farrington, Jr. et al. | |
| 5,791,801 | A | 8/1998 | Miller | |
| 5,792,213 | A | 8/1998 | Bowen | |
| 5,804,401 | A | 9/1998 | Gardiol et al. | |
| 5,891,422 | A | 4/1999 | Pan et al. | |
| 5,911,915 | A | 6/1999 | Fonsny et al. | |
| 5,916,862 | A | 6/1999 | Morelli et al. | |
| 5,942,482 | A | 8/1999 | Zocchi et al. | |
| 5,962,112 | A | 10/1999 | Haynes et al. | |
| 5,994,283 | A | 11/1999 | Durbut et al. | |
| 6,017,417 | A | 1/2000 | Wendt et al. | |
| D428,267 | S | 7/2000 | Romano, III et al. | |
| 6,093,665 | A | 7/2000 | Sayovitz et al. | |
| 6,103,061 | A | 8/2000 | Anderson et al. | |
| 6,147,039 | A | 11/2000 | Jacques et al. | |
| 6,156,421 | A | 12/2000 | Stopper et al. | |
| 6,197,404 | B1 | 3/2001 | Varona | |
| 6,200,941 | B1 | 3/2001 | Strandburg et al. | |
| 6,215,038 | B1 | 4/2001 | Davis et al. | |
| 6,248,125 | B1 | 6/2001 | Helming | |
| 6,303,046 | B1 | 10/2001 | Risen, Jr. et al. | |
| 6,303,557 | B1 | 10/2001 | Colclough | |
| 6,315,864 | B2 | 11/2001 | Anderson et al. | |
| 6,409,770 | B1 | 6/2002 | Weiss et al. | |
| 6,432,270 | B1 | 8/2002 | Liu et al. | |
| 6,536,974 | B2 * | 3/2003 | Redmond | 401/133 |
| 6,729,786 | B1 * | 5/2004 | Tufts et al. | 401/133 |
| 2003/0135181 | A1 | 7/2003 | Chen et al. | |
| 2004/0053803 | A1 | 3/2004 | Lye et al. | |

FOREIGN PATENT DOCUMENTS

| | | |
|---|---|---|
| DE | 3335614 | 4/1985 |
| EP | 0307376 | 3/1989 |
| EP | 0369678 | 5/1990 |
| EP | 0603931 | 6/1994 |
| GB | 1225713 | 3/1971 |
| JP | 55017571 | 2/1980 |
| JP | 56030869 | 3/1981 |
| JP | 58191167 | 11/1983 |
| JP | 60021255 | 2/1985 |
| JP | 62049932 | 3/1987 |
| JP | 63147652 | 6/1988 |
| JP | 02290201 | 11/1990 |
| JP | 4147863 | 5/1992 |
| JP | 5017712 | 1/1993 |
| JP | 5320549 | 12/1993 |
| JP | 7097597 | 4/1995 |
| JP | 9031378 | 2/1997 |
| JP | 10060339 | 3/1998 |
| JP | 10202910 | 8/1998 |
| WO | WO 9111105 | 8/1991 |
| WO | WO 9638548 | 12/1996 |
| WO | WO 9707729 | 3/1997 |
| WO | WO 9928411 | 6/1999 |
| WO | WO 03106333 | 12/2003 |

OTHER PUBLICATIONS

KC# 18071, filed Sep. 13, 2002, U.S. Appl. No. 10/242,815 entitled "Method for Enhancing Cleansing Vehicles and Cleansing Vehicles Utilizing such Methods".

KC# 15071, filed Sep. 13, 2002, U.S. Appl. No. 10/243,233. "Method for Enzyme Mediated Removal of Gas From Inks, and Reduced Gas Links".

Filed Dec. 21, 2001, U.S. Appl. No. 10/036,736, entitled "Sponge-Like Pad Comprising Paper Layers and Method of Manufacture".

Filed Dec. 20, 2001, U.S. Appl. No. 10/027,261, entitled "Activatable Laminate Structures".

Filed Dec. 22, 2003, U.S. Appl. No. 10/744,238, entitled "Multi Purpose Cleaning Product Including a Foam and a Web".

Filed Oct. 25, 2002, U.S. Appl. No. 10/281,511, entitled "Single Piece Face Mask".

www.happi.com_skin creme formulas Sep. 10, 2002.

J.G. Stark, Chemistry Data Book-Second Edition in SI, Aug. 1982, pp. 60-61.

L. Stryer, Biochemistry-Second Edition 1981, Chapter 6, Introduction to Enzymes, pp. 104-121.

http:www.chem..qmul.ac.uk/iubmb/enzyme/nomenclature Committee of the International Union of Biochemistry and Molecular Biology, "Enzyme Nomenclature" Jul. 27, 2002.

www.drugstore.com/templates/brand/default.asp?brand=7840 Sep. 4, 2002.

http://class.fst.ohio-state.edu/fst605/lectures/Lect13.html "enaymatic Reations" Aug. 2, 2002.

* cited by examiner

ACTIVATABLE CLEANING PRODUCTS

BACKGROUND OF THE INVENTION

Cleaning products (e.g., mop, hand held pad, etc.) are used for cleaning a variety of surfaces, such as floors, ovens, carpets and bathtubs. Typically, the cleaning product is dipped into a cleansing solution and then applied to the surface being cleaned. Alternatively, the cleansing solution may be applied directly to the surface being cleaned, and then wiped with a pad. The cleansing solution increases the speed at which the surface is cleaned, decreases the effort a user must exert to clean the surface, and improves the overall quality of the cleaning process. Moreover, cleaning products may also be packaged with a chamber, such as a capsule, which stores the cleansing solution prior to use. A user may release the cleansing solution from the chamber and subsequently use the cleansing solution during cleaning. This configuration avoids the inconvenience of providing a separate source of cleansing solution, ensures a particular type of cleansing solution is used, and allows for the actual amount of cleansing solution used to be regulated.

Unfortunately, packaging a cleaning product with a cleansing solution is often detrimental to the shelf life and effectiveness of the cleansing solution. For example, hydrogen peroxide is a common cleansing solution that may be used as a whitener, brightener, cleanser, antimicrobial agent, and/or oxidizer. However, hydrogen peroxide becomes unstable when exposed to ultraviolet light. Thus, because the cleaning product is exposed to ultraviolet light over time, the shelf life and effectiveness of hydrogen peroxide is usually reduced when packaged along with the cleaning product.

Cleansing solution may sometimes be packaged in a spray bottle or other container. A user may apply the cleansing solution to a surface and then use a cleaning product, such as a sponge, to work the cleansing solution across the surface to remove dirt and other contaminants. This type of arrangement may be problematic in that a pair of objects, the spray bottle and sponge, are needed. For example, if one of the objects becomes lost or otherwise runs out, a user will not be able to conduct or continue cleaning.

Accordingly, a need exists for a cleaning product that helps increase the effectiveness and shelf life of cleansing solutions and other materials associated with cleaning products.

SUMMARY OF THE INVENTION

In accordance with one embodiment, a cleaning product is disclosed that comprises a reservoir containing a first reactant. The reservoir ruptures upon the application of a certain force to release the first reactant. The cleaning product also comprises a cleaning pad configured to clean a surface, wherein a second reactant is applied to the cleaning pad that is placed into contact with the first reactant when the reservoir is ruptured.

In accordance with another embodiment, a method for cleaning a surface with a cleaning product is disclosed. The cleaning product comprises a reservoir and a cleaning pad, wherein a first reactant is contained within the reservoir and a second reactant is applied to the cleaning pad. The method comprises rupturing the reservoir to release the first reactant therefrom; allowing the first reactant to contact the second reactant; and thereafter, contacting the surface with the cleaning pad.

Other features and aspects are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
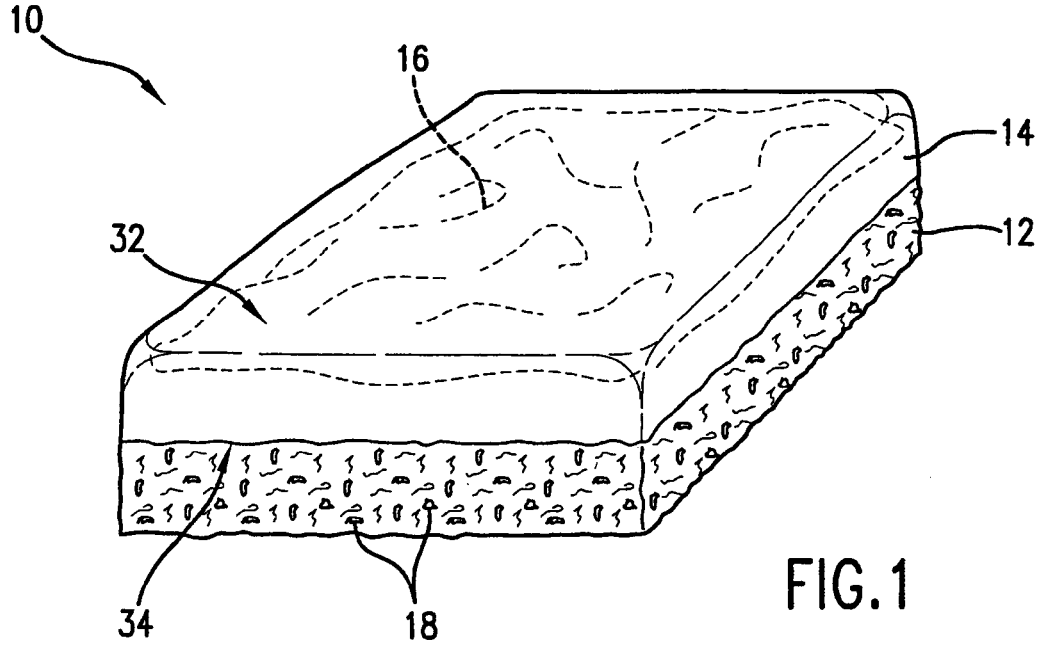
FIG. 1 is a perspective view of a cleaning product in accordance with one exemplary embodiment of the present invention in a non-activated state.

Repeat use of reference characters in the present specification and drawings is intended to represent same or analogous features or elements of the invention.

DETAILED DESCRIPTION OF REPRESENTATIVE EMBODIMENTS

Definitions

As used herein, the term "nonwoven web" refers to a web having a structure of individual fibers or threads that are interlaid, but not in an identifiable manner as in a knitted fabric. Nonwoven webs include, for example, meltblown webs, spunbond webs, carded webs, wet-laid webs, airlaid webs, etc.

As used herein, the term "spunbond web" refers to a nonwoven web formed from small diameter continuous filaments. The web is formed by extruding a molten thermoplastic material as filaments from a plurality of fine, usually circular, capillaries of a spinnerette with the diameter of the extruded filaments then being rapidly reduced as by, for example, eductive drawing and/or other well-known spunbonding mechanisms. The production of spunbond webs is described and illustrated, for example, in U.S. Pat. No. 4,340,563 to Appel, et al., U.S. Pat. No. 3,692,618 to Dorschner, et al., U.S. Pat. No. 3,802,817 to Matsuki, et al., U.S. Pat. No. 3,338,992 to Kinney, U.S. Pat. No. 3,341,394 to Kinney, U.S. Pat. No. 3,502,763 to Hartman, U.S. Pat. No. 3,502,538 to Levy, U.S. Pat. No. 3,542,615 to Dobo, et al., and U.S. Pat. No. 5,382,400 to Pike, et al., which are incorporated herein in their entirety by reference thereto for all purposes. Spunbond fibers are generally not tacky when they are deposited onto a collecting surface. Spunbond fibers may sometimes have diameters less than about 40 microns, and are often between about 5 to about 20 microns.

As used herein, the term "meltblown web" refers to a nonwoven web formed by extruding a molten thermoplastic material through a plurality of fine, usually circular, die capillaries as molten threads or filaments into converging high velocity gas (e.g. air) streams that attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin, et al., which is incorporated herein in its entirety by reference thereto for all purposes. Generally speaking, meltblown fibers may be microfibers that may be continuous or discontinuous, are generally smaller than 10 microns in diameter, and are generally tacky when deposited onto a collecting surface.

As used herein, the term "reactant" refers to a material that is capable of physically and/or chemically interacting in some manner with another material when intermixed. For example, reactants may physically interact such that their physical form is altered in some manner (e.g., cement and water, plaster of paris and water, flour and water, epoxy and hardener, surfactant dissolved in water, medicament dissolved in water, etc.). The reactants may also chemically interact, such as reacting to produce a certain result (e.g., heat; gases, such as reacting baking soda and vinegar to produce carbon dioxide gas; etc.).

DETAILED DESCRIPTION

Reference will now be made in detail to embodiments of the invention, one or more examples of which are illustrated in the drawings. Each example is provided by way of explanation of the invention, and not meant as a limitation of the invention. For example, features illustrated or described as part of one embodiment may be used with another embodiment to yield still a third embodiment. It is intended that the present invention include these and other modifications and variations.

The present invention is generally directed to a cleaning product that contains reactants that may be activated by a user. In particular, the cleaning product has a reservoir in which is contained a first reactant. The reservoir may be ruptured to release the first reactant, thereby allowing it to combine with a second reactant applied to a cleaning pad. The reaction may result in the formation of a cleaning agent, such as a peroxide or cleansing solution, which may enhance the ability of the pad to clean a surface.

Figure 2:
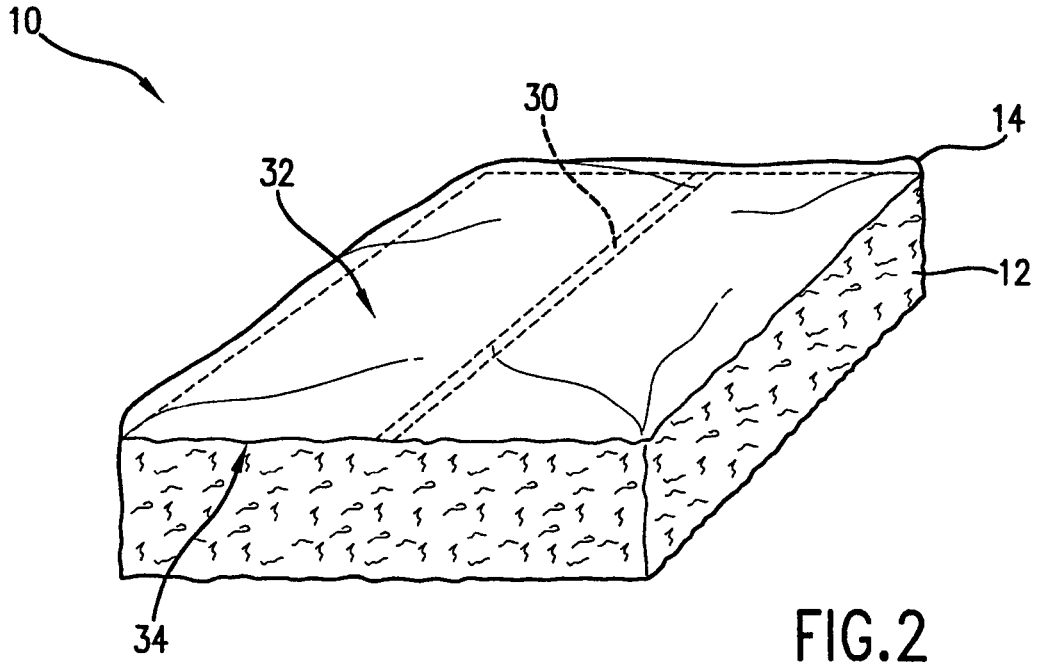
FIG. 2 is a perspective view of the cleaning product of FIG. 1 after being activated.

Referring to FIGS. 1 and 2, for example, an exemplary embodiment of a cleaning product 10 of the present invention is illustrated. FIG. 1 shows cleaning product 10 in a pre-reaction state (e.g., dry), while FIG. 2 shows cleaning product 10 in a post-reaction state. In the pre-reaction state of FIG. 1, a first reactant 16 is contained within a reservoir 14 carried by a cleaning pad 12. The cleaning product 10 may be activated to rupture reservoir 14 and release first reactant 16. Upon release, first reactant 16 then contacts a second reactant 18 applied to cleaning pad 12. Generally, second reactant 18 may be located on a surface of cleaning pad 12 contacting the surface to be cleaned, on a surface of cleaning pad 12 facing reservoir 14, and/or within cleaning pad 12. For example, in some embodiments, second reactant 18 is sprayed or coated onto a surface of cleaning pad 12. In other embodiments, second reactant 18 is mixed with a fibrous material used to form cleaning pad 12.

A user may activate cleaning product 10 in a variety of different ways. For example, activation may occur through the application of a force to reservoir 14, thereby causing it to rupture and allowing the release of first reactant 16. In some embodiments, a user may apply pressure (e.g., twist, squeeze, stretch, compress, snap, fold, etc.) to the reservoir 14 to cause it to rupture and release first reactant 16. For example, the reservoir 14 may be opened upon distorting the shape of the reservoir 14. Upon release, first reactant 16 may then be absorbed by cleaning pad 12 and react with second reactant 18 to place cleaning pad 12 into the desired post-reaction state. Although described as being activated by the hands of a user, the cleaning product 10 may also be configured for use with a mop or other device that is also capable of causing activation. For example; the cleaning product 10 may be located on a mop head that may be pressed against a floor in order to effect activation. Alternatively, the mop head may be provided with a lever or other device that may be pulled by a user in order to rupture the reservoir 14 and cause activation.

Figure 3:
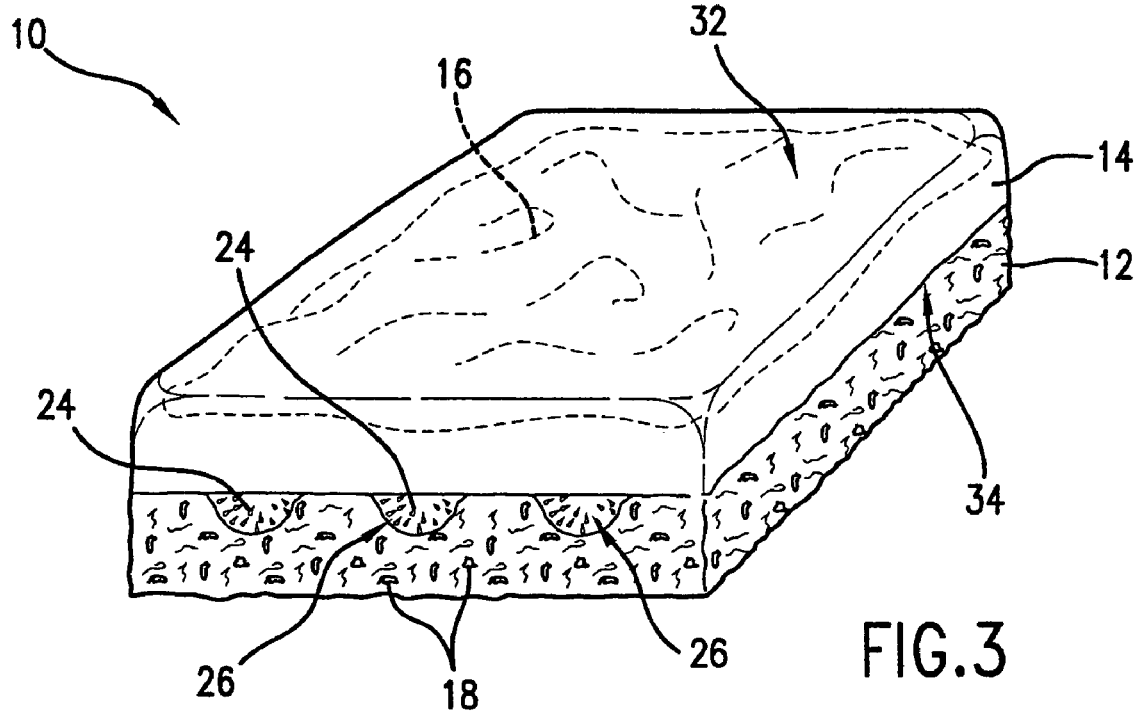
FIG. 3 is a perspective view of a cleaning product in accordance with one exemplary embodiment of the present invention that has a plurality of puncture members disposed in cavities.
Figure 4:
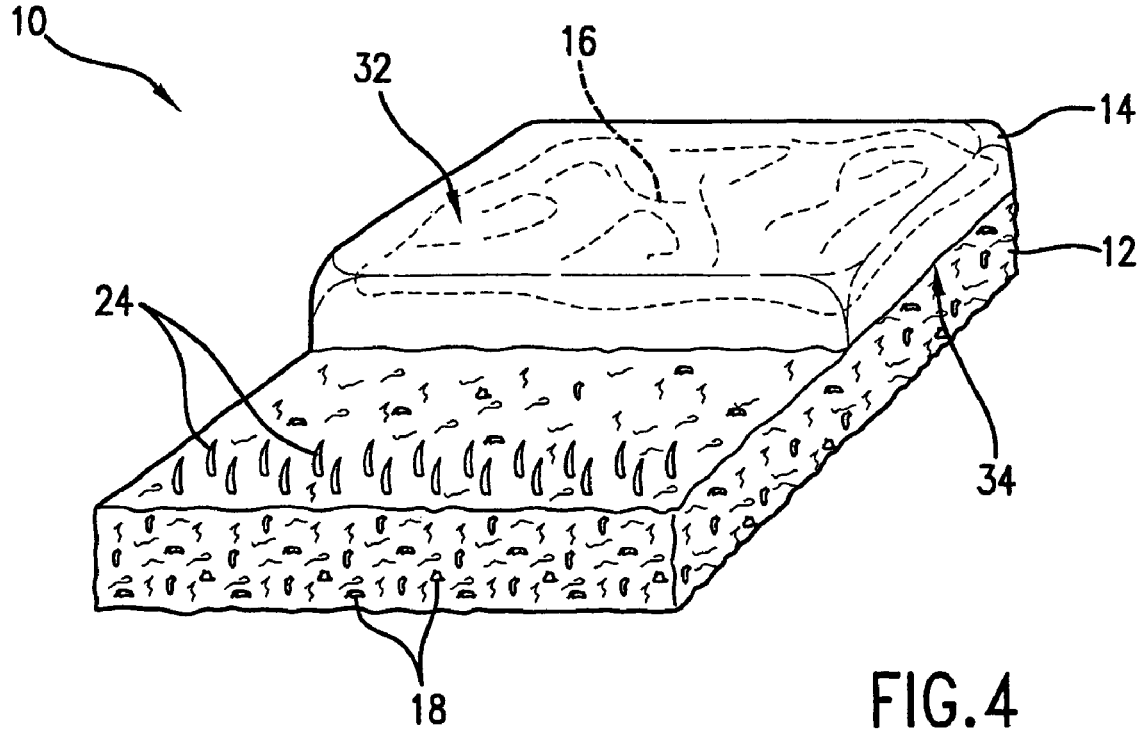
FIG. 4 is a perspective view of a cleaning product in accordance with one exemplary embodiment of the present invention that has a plurality of puncture members located on a surface of a cleaning pad.

Another mechanism for opening reservoir 14 is shown in FIG. 3. Here, cleaning pad 12 defines a plurality of cavities 26 on the surface facing cleaning pad 12. A plurality of puncture members 24, such as hooks or spikes, are disposed in cavities 26. To activate cleaning product 10, a user applies pressure to force reservoir 14 into cavities 26, hence rupturing reservoir 14 with the puncture members 24. Subsequently, the first reactant 16 is released from reservoir 14, and intermixes with second reactant 18. FIG. 4 shows a variation of the cleaning pad 10 shown in FIG. 3 in which cavities 26 are not present. Instead, the puncture members 24 are placed on a surface of cleaning pad 12. In this instance, a user may deform cleaning pad 12 and/or reservoir 14 to move puncture members 24 into engagement with reservoir 14. After rupturing reservoir 14, first reactant 16 is released and subsequently reacts with second reactant 18. Although a plurality of puncture members 24 are shown in FIGS. 3-4, it should be understood that a single puncture member 24 is equally suitable.

Figure 5:
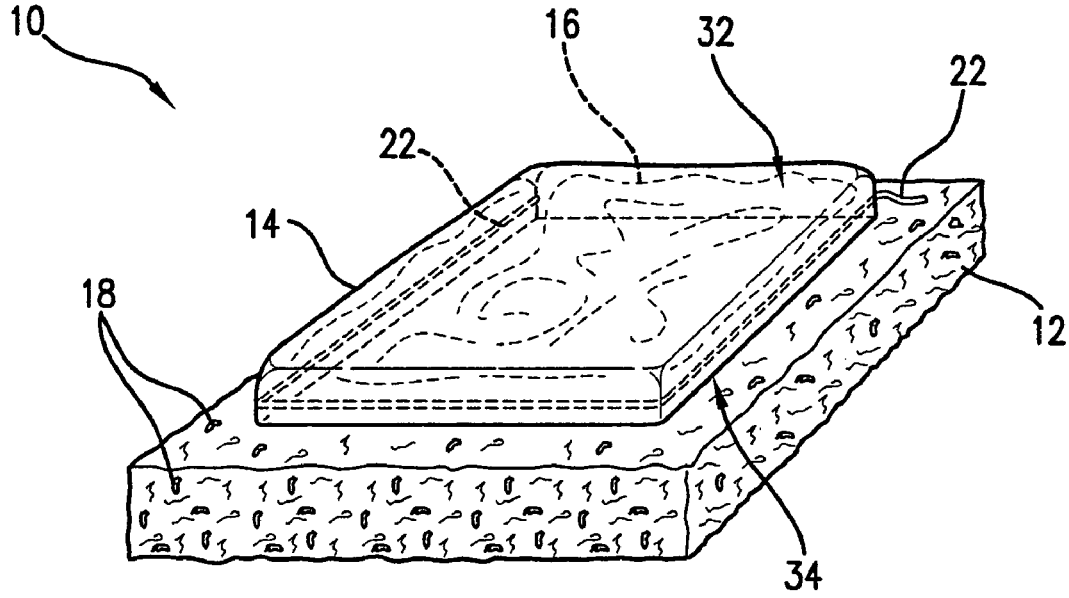
FIG. 5 is a perspective view of a cleaning product in accordance with one exemplary embodiment of the present invention that has a cord for activating the cleaning product.

Still another method of activating cleaning product 10 is shown in FIG. 5. In this embodiment, a cord 22 is provided that may be pulled by a user to rupture at least a portion of the perimeter of reservoir 14. Cord 22 may be a separate member located on the outside, inside, or within reservoir 14. Alternatively, cord 22 may be an integral component of reservoir 14. For example, cord 22 may be formed by a series of weakened portions along a wall of reservoir 14. Pulling on a portion of reservoir 14 disposed between these weakened portions will thus cause them to tear away and rupture reservoir 14.

Figure 6:
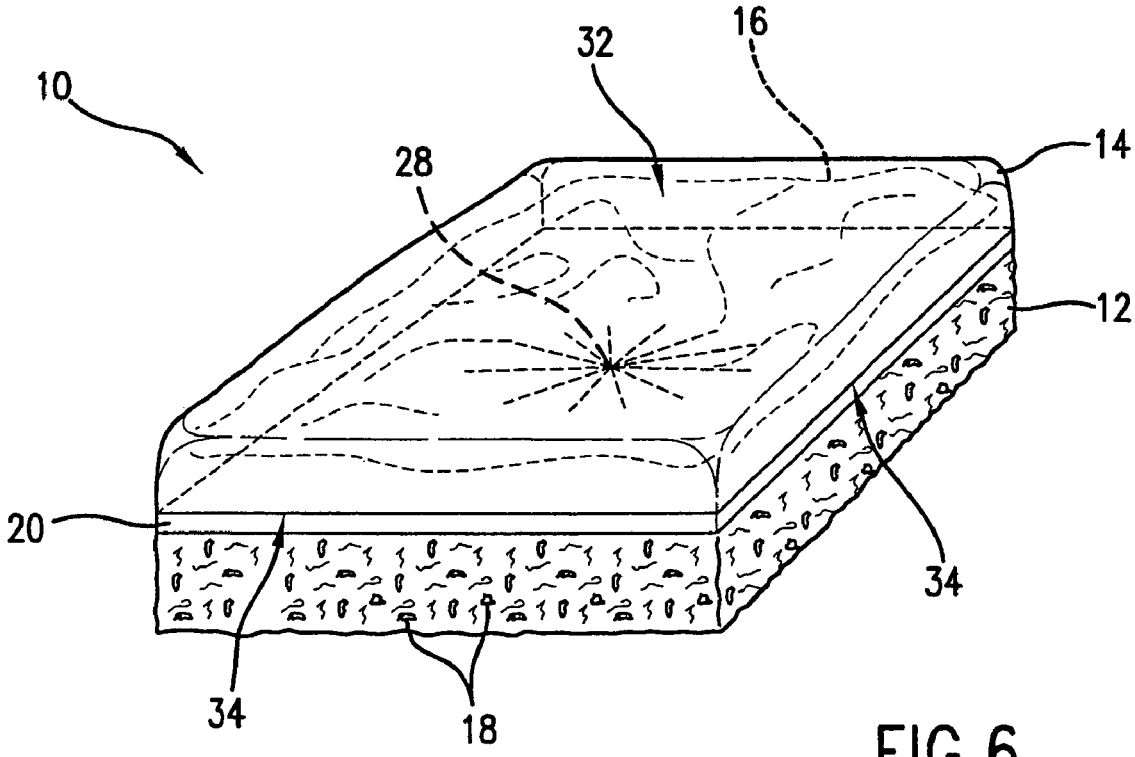
FIG. 6 is a perspective view of a cleaning product in accordance with one exemplary embodiment of the present invention that has a liquid distribution layer for evenly and rapidly applying a first reactant to the cleaning pad.

FIG. 6 shows another embodiment of the cleaning product 10 in which reservoir 14 is provided with a weakened section 28 on inner surface 34. Pressure applied to reservoir 14 causes weakened section 28 to rupture before any other portion of reservoir 14 ruptures. Weakened section 28 may, for example, be a series of perforations in reservoir 14, or may be a series of cuts that extend through approximately one half the thickness of reservoir 14.

Figure 7:
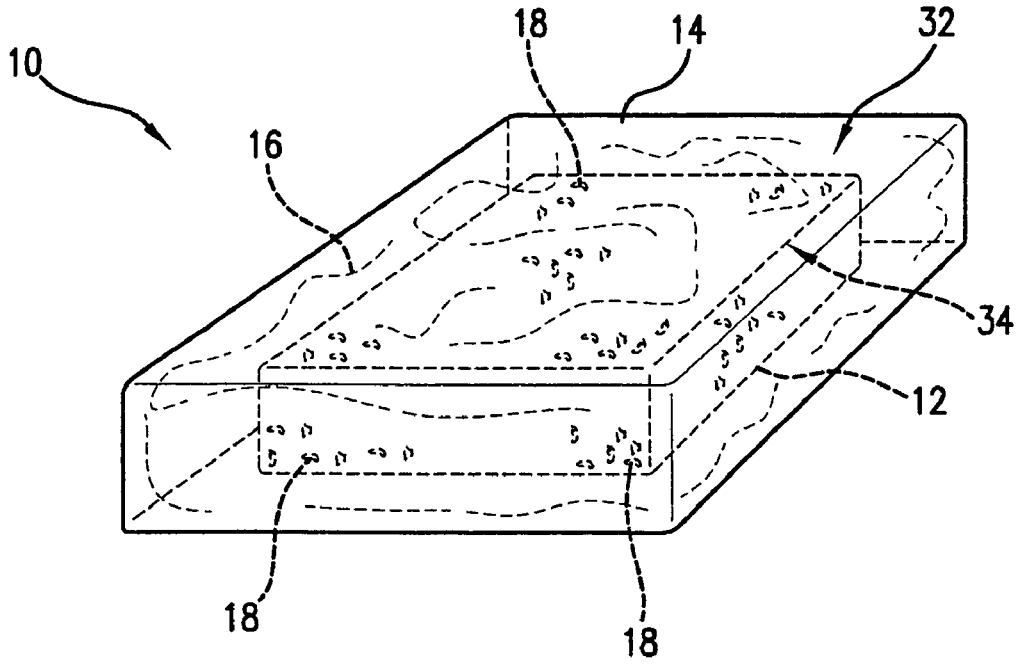
FIG. 7 is a perspective view of a cleaning product in accordance with one exemplary embodiment of the present invention. A reservoir surrounds the cleaning pad on all sides except for one surface of the cleaning pad used to contact the surface being cleaned.
Figure 8:
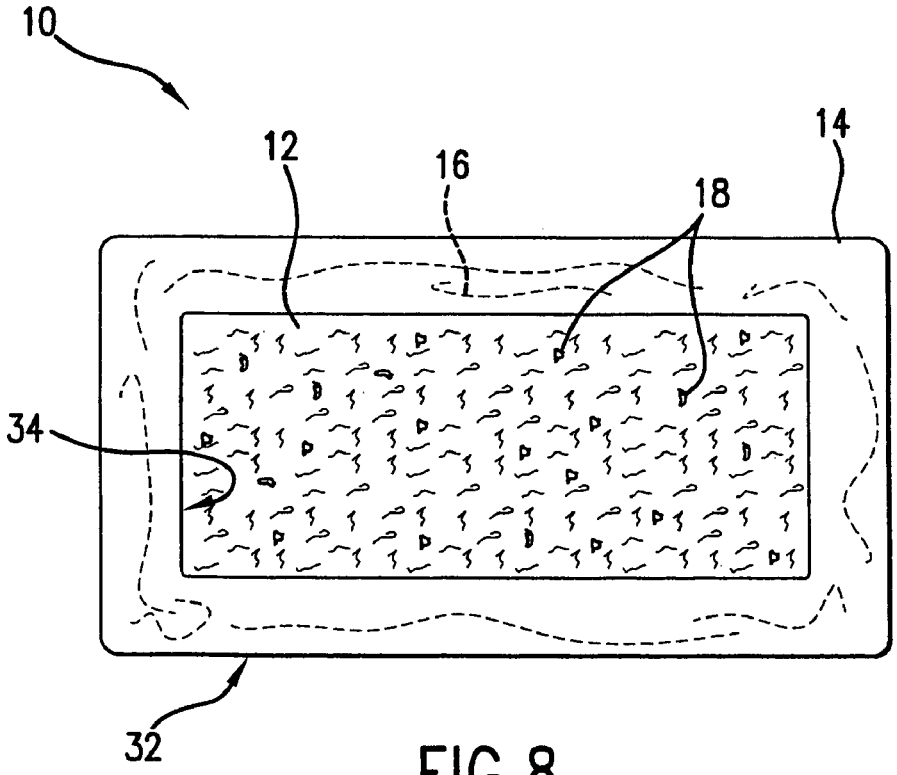
FIG. 8 is a bottom view of the cleaning product of FIG. 7.

FIGS. 7 and 8 show yet another embodiment of the cleaning product 10 in which reservoir 14 surrounds all but a single surface of cleaning pad 12. In this embodiment, as is true with all embodiments; the cleaning pad 12 may remain dry prior to activation. Upon activation, a cleansing solution, for instance, may form that is absorbed by cleaning pad 12. A user may then use cleaning pad 12 and the resulting cleaning solution to clean a surface. By holding only reservoir 14, the user may also avoid contact with the cleansing solution during use. Although shown as being located on an exterior of cleaning pad 12, the reservoir 14 may also be contained within the cleaning pad 12 in accordance with some embodiments of the present invention.

Regardless of the particular configuration of the cleaning product 10, the materials used to form the reservoir 14 and the cleaning pad 12 may generally vary depending on a certain factors, such as the intended use of the cleaning product, the type of reactants used, and so forth. For example, the materials used to form the reservoir 14 may be selected to facilitate its ability to rupture. In some embodiments, films, nonwoven webs, woven fabrics, knitted fabrics, or combinations thereof (e.g., nonwoven fabric laminated to a film), may be used to form the reservoir 14. When utilized, for example, the films may be formed from a variety of different materials. For instance, some suitable thermoplastic polymers used in the fabrication of films may include, but are not limited to, polyolefins (e.g., polyethylene, polypropylene, etc.), including homopolymers, copolymers, terpolymers and blends thereof; ethylene vinyl acetate; ethylene ethyl acrylate; ethylene acrylic acid; ethylene methyl acrylate; ethylene normal butyl acrylate; polyurethane; poly(ether-ester); poly(amid-ether) block copolymers; and so forth. In some instances, the thickness of the films may be selected within a certain range to enhance the flexibility of the reservoir 14. Thus, in some embodiments, the thickness of the films may be less than about 0.05 inches, in some embodiments between about 0.0003 inches to about 0.01 inches, and in some embodiments, between about 0.0007 inches to about 0.02 inches.

As stated, nonwoven webs may also be utilized. Typically, the nonwoven webs contain synthetic monocomponent or multicomponent fibers. The synthetic fibers may be formed from a variety of thermoplastic polymers. For example, some suitable thermoplastics include, but are not limited to, polyvinyl chlorides; polyesters; polyamides; polyolefins (e.g., polyethylene, polypropylenes, polybutylenes, etc.); polyurethanes; polystyrenes; polyvinyl alcohols; copolymers, terpolymers, and blends of the foregoing; and so forth. In some instances, the basis weight and/or the thickness of the nonwoven webs may be selected within a certain range to enhance the flexibility of the reservoir 14. Thus, in some embodiments, the thickness of the nonwoven webs may be less than about 0.1 inches, in some embodiments between about 0.005 inches to about 0.06 inches, and in some embodiments, between about 0.015 inches to about 0.03 inches. Moreover, in some embodiments, the basis weight of the nonwoven webs may be less than about 5 ounces per square yard, in some embodiments, between about 0.5 to about 4 ounces per square yard, and in some embodiments, between about 1 to about 2 ounces per square yard.

The permeability of the material(s) used to form the reservoir 14 may also be selected to optimize various characteristics of the cleaning product 10. For example, it is typically desired that the reservoir 14 be impermeable to at least the first reactant 16 so that premature activation does not occur. In particular, when one or more of the first reactants 16 contains a liquid, the reservoir 14 is typically formed from a liquid impermeable material, such as a polypropylene or polyethylene film. Liquid-impermeable materials that are vapor permeable may also be used, such as those described in U.S. Pat. No. 4,828,556 to Braun et al.; U.S. Pat. No. 5,591,510 to Junker et al.; and U.S. Pat. No. 6,156,421 to Stopper, et al., which are incorporated herein in their entirety by reference thereto for all purposes. Moreover, when one or more of the reactants is a vapor, the inner substrate 16 is typically vapor impermeable.

Apart from having a desired permeability, the materials for reservoir 14 may also facilitate activation of the cleaning product 10. In the embodiment shown in FIG. 2, for example, the reservoir 14 may be formed in such a manner that it ruptures at an opening 30. In addition, reservoir 14 may possess an outer surface 32 having a greater strength than an inner surface 34. In other embodiments, outer surface 32 may simply be more "extensible" in the direction of stretch than inner surface 34. As used herein, the term "extensible" generally refers to a material, that when stretched, may stretch at least about 30% in the direction of stretching without substantially rupturing. By being more extensible or having a greater strength than inner surface 34, outer surface 32 may better withstand a particular force. This generally allows inner surface 34 to rupture prior to outer surface 32. Such differences in strength and/or extensibility may be accomplished in a variety of different ways. For example, the inner surface 34 of reservoir 14 may be made of a film that is less extensible than a film that forms the outer surface 32. In another embodiment, portions of reservoir 14 that are desired to rupture first may be thinner than the other portions of reservoir 14. Alternatively, reservoir 14 may be made of the same material and thickness, but treated to allow one portion to rutpure before another. For example, inner surface 34 may be weakened through heat treatment or mechanical stretching, while outer surface 32 is left untreated. Of course, as those of ordinary skill in the art would recognize, numerous other embodiments are also possible.

The cleaning pad 12 may also be formed from any of a variety of materials known in the art. For example, the cleaning pad 12 typically contains an absorbent material of sufficient wet strength and absorbency to hold an effective amount of fluid. For example, the cleaning pad 12 may include a nonwoven web, woven materials, knit materials, wet-strength paper, or combinations thereof. Materials and processes suitable for forming such a cleaning pad are well known to those skilled in the art.

For instance, some examples of nonwoven webs that may used in the present invention include, but are not limited to, spunbonded webs (apertured or non-apertured), meltblown webs, bonded carded webs, air-laid webs, coform webs, hydraulically entangled webs, and so forth. In addition, nonwoven webs may contain synthetic fibers (e.g., polyethylenes, polypropylenes, polyvinyl chlorides, polyvinylidene chlorides, polystyrenes, polyesters, polyamides, polyimides, etc.); cellulosic material such as cellulosic fibers (softwood pulp, hardwood pulp, thermomechanical pulp, cotton, linen, regenerated cellulose, etc.); or combinations thereof. If desired, the nonwoven web may also be bonded using techniques well known in the art to improve the durability, strength, hand, aesthetics, texture, and/or other properties of the fabric. For instance, the nonwoven web may be thermally (e.g., pattern bonded), ultrasonically, adhesively and/or mechanically (e.g., through-air dried) bonded. For instance, various pattern bonding techniques are described in U.S. Pat. No. 3,855,046 to Hansen; U.S. Pat. No. 5,620,779 to Levy, et al.; U.S. Pat. No. 5,962,112 to Haynes, et al.; U.S. Pat. No. 6,093,665 to Sayovitz, et al.; U.S. Design Pat. No. 428,267 to Romano, et al.; and U.S. Design Pat. No. 390,708 to Brown, which are incorporated herein in their entirety by reference thereto for all purposes.

The nonwoven web may be bonded by continuous seams or patterns. As additional examples, the nonwoven web may be bonded along the periphery of the sheet or simply across the width or cross-direction (CD) of the web adjacent the edges. Other bond techniques, such as a combination of thermal bonding and latex impregnation, may also be used. Alternatively and/or additionally, a resin, latex or adhesive may be applied to the nonwoven fabric by, for example, spraying or printing, and dried to provide the desired bonding. Still other suitable bonding techniques may be described in U.S. Pat. No. 5,284,703 to Everhart, et al., U.S. Pat. No. 6,103,061 to Anderson, et al., and U.S. Pat. No. 6,197,404 to Varona, which are incorporated herein in their entirety by reference thereto for all purposes.

If desired, the nonwoven web may also be imparted with texture on one or more of its surfaces. For instances, techniques for forming dual-textured spunbond or meltblown materials are described in U.S. Pat. No. 4,659,609 to Lamers, et al. and U.S. Pat. No. 4,833,003 to Win, et al., which are incorporated herein in their entirety by reference thereto for all purposes.

In still another embodiment, the cleaning pad 12 may contain one or more paper-based webs. For example, the cleaning pad 12 may be a single-ply paper product in which the web forming the product is stratified, i.e., has multiple layers, or a multi-ply product in which the webs forming the product may themselves be either single or multi-layered. However, it should be understood that the cleaning pad 12 may include any number of plies or layers and may be made from various types of fibers. Regardless of the exact construction of the paper-based cleaning pad 12, one or more layers of the pad may be incorporated with pulp fibers. The pulp fibers may include fibers formed by a variety of pulping processes, such as kraft pulp, sulfite pulp, thermomechanical pulp, etc. Further, the pulp fibers may have any high-average fiber length pulp, low-average fiber length pulp, or mixtures of the same. One example of suitable high-average length pulp fibers include softwood fibers such as, but not limited to, northern softwood, southern softwood, redwood, red cedar, hemlock, pine (e.g., southern pines), spruce (e.g., black spruce), combinations thereof, and so forth. Exemplary commercially available pulp fibers suitable for the present invention include those available from Kimberly-Clark Corporation under the trade designations "Longlac-19." One example of suitable low-average length fibers include hardwood fibers, such as, but not limited to, eucalyptus, maple, birch, aspen, and so forth, may also be used. In certain instances, eucalyptus fibers may be particularly desired to increase the softness of the web. Eucalyptus fibers may also enhance the brightness, increase the opacity, and change the pore structure of the web to increase its wicking ability. Other suitable pulp fibers include thermomechanical pulp fibers, chemithermomechanical pulp fibers, bleached chemithermomechanical pulp fibers, chemimechanical pulp fibers, refiner mechanical pulp (RMP) fibers, stone groundwood (SGW) pulp fibers, and peroxide mechanical pulp (PMP) fibers. Thermomechanical pulp (TMP) fibers are produced by steaming wood chips at elevated temperature and pressure to soften the lignin in the wood chips. Steaming the wood softens the lignin so that fiber separation occurs preferentially in the highly lignified middle lamella between the fibers, facilitating the production of longer, less damaged fibers. Moreover, if desired, secondary fibers obtained from recycled materials may be used, such as fiber pulp from sources such as, for example, newsprint, reclaimed paperboard, and office waste.

A paper-based web may generally be formed according to a variety of papermaking processes known in the art. In fact, any process capable of making a paper web may be utilized in the present invention. For example, a papermaking process of the present invention may utilize wet-pressing, creping, through-air-drying, creped through-air-drying, uncreped through-air-drying, single recreping, double recreping, calendering, embossing, air laying, as well as other steps in processing the paper web. In some embodiments, in addition to the use of various chemical treatments, such as described above, the papermaking process itself may also be selectively varied to achieve a web with certain properties.

For instance, techniques for forming a creped paper web are described in U.S. Pat. No. 5,637,194 to Ampulski et al., which is incorporated herein in its entirety by reference thereto for all purposes. Likewise, techniques for forming an uncreped through-dried paper web are disclosed in U.S. Pat. No. 5,048,589 to Cook, et al.; U.S. Pat. No. 5,399,412 to Sudall, et al.; U.S. Pat. No. 5,510,001 to Hermans, et al.; U.S. Pat. No. 5,591,309 to Rugowski, et al.; U.S. Pat. No. 5,772,845 to Farrington, Jr. et al.; U.S. Pat. No. 6,017,417 to Wendt, et al., and U.S. Pat. No. 6,432,270 to Liu, et al., which are incorporated herein in their entirety by reference thereto for all purposes. Uncreped through-drying generally involves the steps of: (1) forming a furnish of cellulosic fibers, water, and optionally, other additives; (2) depositing the furnish on a traveling foraminous belt, thereby forming a fibrous web on top of the traveling foraminous belt; (3) subjecting the fibrous web to through-drying to remove the water from the fibrous web; and (4) removing the dried fibrous web from the traveling foraminous belt. Through-air drying may increase the bulk and softness of the web.

Cleaning pad 12 may also be configured as a sponge-like product that includes a multi-layer compressible substrate made from a plurality of stacked plies each made from a textured paper web. One such example of a sponge-like pad that incorporates paper layers is described in U.S. Patent Application Publication No. 2003/0135181 to Chen, et al., which is incorporated herein in its entirety by reference thereto for all purposes.

Cleaning pad 12 may also be made of a foam, for example the foam used may be that described in U.S. patent application Ser. No. 10/744,238 filed on Dec. 22, 2003 titled, "Multi Purpose Cleaning Product Including a Foam and a Web." The foam used to make the cleaning pad 12 may be made from cellulose, regenerated cellulose, or from cellulose regenerated from a solution. Alternatively, the cleaning pad 12 may be made from polyurethane, a natural sponge, or a synthetic sponge. The cleaning pad 12 may have an open or closed cell structure.

In another embodiment, the cleaning pad 12 may also contain a hydroentangled nonwoven composite. Hydroentangling processes and hydroentangled composite webs containing various combinations of different fibers are known in the art. A typical hydroentangling process utilizes high pressure jet streams of water to entangle fibers and/or filaments to form a highly entangled consolidated fibrous structure, e.g., a nonwoven fabric. Hydroentangled nonwoven fabrics of staple length fibers and continuous filaments are disclosed, for example, in U.S. Pat. No. 3,494,821 to Evans and U.S. Pat. No. 4,144,370 to Bouolton, which are incorporated herein in their entirety by reference thereto for all purposes. Hydroentangled composite nonwoven materials of a continuous filament nonwoven web and a pulp layer are disclosed, for example, in U.S. Pat. No. 5,284,703 to Everhart, et al. and U.S. Pat. No. 6,315,864 to Anderson, et al., which are incorporated herein in their entirety by reference thereto for all purposes.

Furthermore, the cleaning pad 12 may also contain a "coform material", which generally refers to composite materials comprising a mixture or stabilized matrix of thermoplastic fibers and a second non-thermoplastic material. As an example, coform materials may be made by a process in which at least one meltblown die head is arranged near a chute through which other materials are added to the web while it is forming. Such other materials may include, but are not limited to, fibrous organic materials such as woody or nonwoody pulp such as cotton, rayon, recycled paper, pulp fluff and also superabsorbent particles, inorganic absorbent materials, treated polymeric staple fibers and so forth. Some examples of such coform materials are disclosed in U.S. Pat. No. 4,100,324 to Anderson, et al.; U.S. Pat. No. 5,284,703 to Everhart, et al.; and U.S. Pat. No. 5,350,624 to Georger, et al.; which are incorporated herein in their entirety by reference thereto for all purposes.

In addition to reservoir 14 and cleaning pad 12, the cleaning product 10 may also contain a variety of other components to facilitate the cleaning process. For example, referring again to FIG. 6, some embodiments of the present invention may employ a liquid distribution layer 20 positioned between reservoir 14 and cleaning pad 12. Such a liquid distribution layer 20 may help uniformly and controllably distribute first reactant 16 to cleaning pad 12. Any of a variety of different materials may generally be used for the liquid-distribution layer 20. For example, airlaid cellulosic webs may be suitable for use in some embodiments of the present invention. Such an airlaid web has a fine pore structure and provides an excellent wicking capacity. In other embodiments, the liquid distribution layer 20 may generally be characterized as substantially hydrophobic. For example, the liquid distribution layer 20 may be a nonwoven web composed of a relatively hydrophobic material, such as polypropylene, polyethylene, polyester, etc. One particular example of a suitable liquid distribution layer 20 is described in U.S. Pat. No. 6,215,038 to Davis, which is incorporated herein by reference thereto in its entirety for all purposes.

The first and second reactants 16, 18 may generally be any suitable solid, liquid, gas, or combination thereof. In some embodiments, for example, first reactant 16 is a liquid and second reactant 18 is a solid, wherein second reactant 18 optionally dissolves in first reactant 16 when intermixed. Although not required, such a selection for the reactants 16, 18 allows the cleaning pad 12 to remain dry prior to activation and to become moist after activation. For instance, when activated to form a cleansing solution, cleaning product 10 may be used for soaking, loosening, and removing stains without the need for scrubbing. Cleaning product 10 may be effective in cleaning hard surfaces, as well as softer surfaces such as fabrics and carpet. Cleaning product 10 may also be designed to clean the skin or hair of a user.

Generally speaking, any reactants that intermix to produce a desirable result for the cleaning product 10 may be utilized in the present invention. For example, in some embodiments, the reactants 16 and 18 are part of an enzyme-catalyzed reaction system that accomplishes a variety of possible results. In other embodiments, the enzyme-catalyzed reaction system produces a compound, such as hydrogen peroxide, which may be used as a cleaning agent to help remove dirt or stains. Creating peroxide at the time of cleaning is also advantageous because it eliminates the need for storage prior to use and the disadvantages associated therewith.

Generally speaking, the enzyme-catalyzed reaction system employs an enzyme that catalyzes a reaction between a donor substrate and an acceptor substrate. Examples of such enzymes include, but are not limited to, (S)-2-hydroxy-acid oxidase, malate oxidase, glucose oxidase, hexose oxidase, cholesterol oxidase, aryl-alcohol oxidase, alcohol oxidase, gylcerol-3-phosphate oxidase, galactose oxidase, tetrahydroberberine oxidase, and so forth. The donor substrate is a reactant that becomes at least partially oxidized through the catalytic action of the enzyme. In some embodiments, the donor substrate may be an alkali metal ascorbate, ascorbic acid, polyvinyl alcohol, glucose, or galactose. For example, when utilizing glucose oxidase enzyme as the reaction catalyst, glucose is a suitable donor substrate because it is oxidized to form gluconic acid in the presence of glucose oxidase. Likewise, when utilizing polyvinyl-alcohol oxidase enzyme, polyvinyl alcohol is a suitable donor substrate. In still another example, when utilizing galactose oxidase enzyme, galactose is a suitable donor substrate. The acceptor substrate reacts with the donor substrate in an enzyme-mediated reaction to become at least partially reduced. Suitable acceptor substrates include, for example, oxygen, air, water, etc. For example, in one embodiment, glucose (donor substrate), oxygen (acceptor substrate), and glucose oxidase (enzyme) may react to form hydrogen peroxide.

Nevertheless, in certain embodiments, it may be desirable to further convert certain products into water. For example, the presence of hydrogen peroxide may be undesired after a certain period of time. In such instances, the formed hydrogen peroxide may be utilized as an acceptor substrate to react with an additional donor substrate in the presence of an additional enzyme. For example, peroxidase (e.g., lactoperoxidase, bromoperoxidase, microperoxidase, etc.) may catalyze the reaction of hydrogen peroxide with ascorbic acid or a salt thereof to form water. Other suitable donor substrates for this reaction include, but are not limited to, phenols, aromatic amines, pyrogallol, guaiacol, ferrocyanide, 4-aminoantipyrine, and cytochrome c. In some embodiments, the donor substrate may also be an indicator for the reaction system. For example, 4-chloro-1-naphthol (4CN) may be a suitable donor substrate indicator. In one particular embodiment, glucose oxidase catalyzes a reaction between glucose and oxygen to form hydrogen peroxide. Thereafter, a peroxidase enzyme catalyzes a reaction between hydrogen peroxide and 4-chloro-1-naphthol to form water. The resulting product has a blue/violet color, which signals the completion of the desired reactions.

It is recognized that the activity of enzymes may diminish in degree over time. Therefore, in some embodiments, a stabilizer or preservative may be incorporated into the cleaning product 10 to counteract this affect. Generally speaking a stabilizer has the ability to help maintain the degree of activity of an enzyme over time without interfering in the catalytic reaction process. Although not required, the stabilizers may be specific to particular enzymes, and their effectiveness may be further influenced by concentration. For example, Bovine Serum Albumin (BSA) is a protein that is commonly used to stabilize enzymes; however, other agents, such as sugars, salts (e.g., calcium salts), carboxylic acids and polyhydric alcohols may also be suitable. Still other examples of suitable stabilizers may include surfactants and electrolytes. In addition, enzyme function may also vary based on pH. Thus, it may be desirable to use one or more pH buffers, such as sodium citrate, trisodium phosphate, disodium hydrogen phosphate, sodium dihydrogen phosphate, sodium or potassium acetates, acetic acid, citric acid, hydrochloric acid, sodium hydroxide, and so forth. Furthermore, various preservatives may also be used to inhibit microbial growth over time as is well known in the art.

An enzyme-catalyzed reaction system may generally be employed into the cleaning product 10 in a variety of different ways. For example, in one embodiment, the cleaning pad 12 contains the enzyme catalyst and donor substrate (designated as second reactant 18). In addition, reservoir 14 contains the acceptor substrate, such as liquid water (designated as first reactant 16). Upon activation, the water intermixes and reacts with the donor substrate in the presence of the enzyme.

In addition to enzyme-catalyzed reaction systems, such as described above, the cleaning product 10 may also be configured to heat or cool the surface being cleaned. In this instance, the first and second reactants 16, 18 may contain materials that undergo an exothermic or endothermic reaction when intermixed. In one embodiment, for example, water and ammonium nitrate ($NH_4NO_3$), which are known to endothermically react when intermixed, may be used. Other examples of materials that may be used for endothermic reactions include salts such as ammonium sulfate, potassium nitrate, sodium nitrate, silver nitrate, ammonium chloride, and ammonium nitrate. In addition, the first and second reactants 16, 18 may also include materials that undergo an exothermic reaction upon intermixing. In one embodiment, for example, super-cooled sodium acetate liquid and sodium acetate crystals (solid), may be used. The super-cooled sodium acetate liquid is stable, but upon activation by the sodium acetate crystals, begins to crystallize and release heat. In still another embodiment, the reactants may contain iron powder and air (with moisture), which exothermically react when intermixed. Other examples of materials that may be used for exothermal reactants include quick lime, sodium hydroxide, cobalt, chromium, iron hydroxide, magnesium, manganese, molybdenum, tin oxide(II), titanium, sodium, sodium acetate crystals, calcium hydroxide, metallic sodium, magnesium chloride, anhydrous calcium chloride ($CaCl_2$), and the hydration of zeolites (e.g. sodium aluminosilicates). Other possible reactants are described in U.S. Pat. No. 5,792,213 to Bowen and U.S. Pat. No. 6,248,125 to Helming, which are incorporated herein in their entirety by reference thereto for all purposes.

In accordance with one exemplary embodiment of the present invention, the cleaning pad 12 may be a sponge that has soap as the second reactant 18 distributed on the surface of the sponge or inside the sponge. The first reactant 16 may be water that is contained within the reservoir 14 attached to the sponge. The reservoir 14 may be ruptured to cause water to react with the soap and hence produce lather for cleaning the surface to be cleaned.

In addition, other types of reactants may also be suitable for use in the present invention. In some embodiments, the reactants may intermix together to form a cleansing solution or foam. For example, in one embodiment, first reactant 16 contains water and second reactant 18 contains one or more surfactants. When mixed together, a cleansing solution is formed that may assist in the removal of dirt, soil, etc. from a surface. Generally speaking, a single surfactant or a mixture of two or more surfactants may be utilized. If a mixture of two or more surfactants is employed, the surfactants may be selected from the same or different classes, provided only that the surfactants present in the mixture are compatible with each other. Any surfactant known to those having ordinary skill in the art may be utilized, including anionic, cationic, nonionic and amphoteric surfactants. Examples of anionic surfactants include, among others, linear and branched-chain sodium alkylbenzenesulfonates; linear and branched-chain alkyl sulfates; linear and branched-chain alkyl ethoxy sulfates; and silicone phosphate esters, silicone sulfates, and silicone carboxylates. Examples of cationic surfactants include, by way of illustration, tallow trimethylammonium chloride and, more generally, silicone amides, silicone amido quaternary amines, and silicone imidazoline quaternary amines. Examples of nonionic surfactants, include, again by way of illustration only, alkyl polyethoxylates; polyethoxylated alkylphenols; fatty acid ethanol amides; dimethicone copolyol esters, dimethiconol esters, and dimethicone copolyols; and complex polymers of ethylene oxide, propylene oxide, and alcohols.

In accordance with another exemplary embodiment of the present invention, the first reactant 16 may be water mixed with a surfactant. The second reactant 18 may be bicarbonate and a solid acid. Interaction between the first and second reactants 16, 18 will produce carbon dioxide that acts as a foaming agent. Here, the carbon dioxide gas will cause bubbles to form on the surfactant to assist in cleaning and to allow a user to know that the reaction has taken place.

Alternatively, the first reactant 16 may be water mixed with citric acid. In this example, the second reactant 18 may include a bicarbonate coated onto the cleaning pad 12 that may be, for instance, a nonwoven layer. The second reactant 18 may also include a dry surfactant such as a powdered detergent. Interaction between the first and second reactants 16, 18 will again cause carbon dioxide gas to form that leads to bubbles and foaming action of the surfactant during cleaning. The cleaning product 10 may also be configured such that the citric acid is not included with the water in the first reactant 16, but is instead provided in a dry state and incorporated with the bicarbonate and surfactant in the second reactant 18

Exemplary embodiments of first reactant 16 and second reactant 18, along with the product formed through their reaction with one another, are shown below in Table 1.

TABLE 1

Exemplary Reactants and Products Thereof

| First Reactant 16 | Second Reactant 18 | Product of the Reaction |
|---|---|---|
| Water | Glucose oxidase + glucose | Peroxidase generating system |
| Water + surfactant | Dry acid (e.g. citric acid) and bicarbonate | Cleansing foam |
| Water | Surfactant | Cleansing solution |
| Water + 4-chloro-1-naphtol | Glucose oxidase + glucose + peroxidase | Blue/violet coloration as oxygen is consumed |

Regardless of the particular reactants chosen, it should be understood that the reaction between first and second reactants 16, 18 need not be a single reaction. For instance, the reaction may provoke a color change in cleaning pad 12 along with a generation of cleansing foam. As such, any number or combinations of different types of reactions between first and second reactants 16, 18 are possible in accordance with the present invention.

The present invention may be better understood with reference to the following example.

EXAMPLE

The ability to form a cleaning product 10 in accordance with the present invention was demonstrated. Initially, the finger of a latex glove was cut off and filled with tap water using a 50-milliliter syringe. A knot was tied in the finger of the latex glove to form a sealed reservoir 14. The tied-off portion of the latex glove was then stapled to a layer of coform material that made up the cleaning pad 12. A tack, acting as the puncture member 24, was located on the coform material proximate to the water-filled finger portion of the latex glove. Pressing the water-filled finger portion against the tack then activated the cleaning product 10. This action caused the water-filled finger portion to be ruptured and release the water onto the layer of coform material.

What is claimed is:

1. A cleaning product comprising:

a reservoir containing a first reactant, the reservoir rupturing upon the application of a force to release the first reactant;

a cleaning pad configured in contact with said reservoir to clean a surface, wherein a second reactant is applied to the cleaning pad, wherein the second reactant is placed into contact with the first reactant when the reservoir is ruptured, the cleaning pad comprising one or more webs containing cellulosic material having a structure of individual fibers that are interlaid in a randomly disbursed pattern.

2. The cleaning product as set forth in claim 1, wherein the first reactant is released through the application of pressure to the reservoir.

3. The cleaning product as set forth in claim 1, wherein the reservoir includes a cord that ruptures the reservoir when pulled.

4. The cleaning product as set forth in claim 1, further comprising at least one puncture member for rupturing the reservoir.

5. The cleaning product as set forth in claim 4, wherein the cleaning pad defines at least one cavity, and wherein the puncture member is located within the cavity.

6. The cleaning product as set forth in claim 1, wherein the reservoir surrounds the cleaning pad such that only a single surface of the cleaning pad is exposed for cleaning.

7. The cleaning product as set forth in claim 1, wherein the reservoir comprises a liquid-impermeable film.

8. The cleaning product as set forth in claim 1, further comprising a liquid distribution layer positioned between the cleaning pad and the reservoir.

9. The cleaning product as set forth in claim 1, wherein the first reactant is a liquid and the second reactant is a solid.

10. The cleaning product as set forth in claim 1, wherein the first and second reactants form a cleansing solution or foam.

11. A cleaning product comprising:

a reservoir containing a first reactant, the reservoir rupturing upon the application of a force to release the first reactant;

a cleaning pad configured in contact with said reservoir to clean a surface, wherein a second reactant is applied to the cleaning pad, wherein the second reactant is placed into contact with the first reactant when the reservoir is ruptured, the cleaning pad comprising one or more webs containing cellulosic material: and wherein the first and second reactants form a peroxide in the presence of an enzyme.

12. The cleaning product as set forth in claim 11, wherein the first reactant is released through the application of pressure to the reservoir.

13. The cleaning product as set forth in claim 11, wherein the reservoir includes a cord that ruptures the reservoir when pulled.

14. The cleaning product as set forth in claim 11, further comprising at least one puncture member for rupturing the reservoir.

15. The cleaning product as set forth in claim 14, wherein the cleaning pad defines at least one cavity, and wherein the puncture member is located within the cavity.

16. The cleaning product as set forth in claim 11, wherein the reservoir surrounds the cleaning pad such that only a single surface of the cleaning pad is exposed for cleaning.

17. The cleaning product as set forth in claim 11, wherein the reservoir comprises a liquid-impermeable film.

18. The cleaning product as set forth in claim 11, further comprising a liquid distribution layer positioned between the cleaning pad and the reservoir.

19. The cleaning product as set forth in claim 11, wherein the first reactant is a liquid and the second reactant is a solid.

20. A cleaning product comprising:

a liquid-impermeable reservoir containing a first reactant, the reservoir rupturing upon the application of a force to release the first reactant;

a cleaning pad configured to clean a surface, wherein said reservoir is disposed on an upper surface of said cleaning pad such that portions of said reservoir remain exposed, and wherein a second reactant is applied to the cleaning pad, wherein the second reactant is placed into contact with the first reactant when the reservoir is ruptured, and wherein the cleaning pad comprises a plurality of webs containing cellulosic material having a structure of individual fibers that are interlaid in a randomly disbursed pattern.

21. The cleaning product as set forth in claim 20, wherein the reservoir includes a cord that ruptures the reservoir when pulled.

22. The cleaning product as set forth in claim 20, further comprising at least one puncture member for rupturing the reservoir.

23. The cleaning product as set forth in claim 22, wherein the cleaning pad defines at least one cavity, and wherein the puncture member is located within the cavity.

24. The cleaning product as set forth in claim 20, wherein the reservoir surrounds the cleaning pad such that only a single surface of the cleaning pad is exposed for cleaning.

* * * * *